United States Patent [19]

Lovelet

[11] Patent Number: 4,993,304

[45] Date of Patent: Feb. 19, 1991

[54] MULTI-ANNULAR MUSICAL DRUM

[76] Inventor: Ken S. Lovelet, P.O. Box 65, Mt. Tremper, N.Y. 12457

[21] Appl. No.: 511,211

[22] Filed: Apr. 19, 1990

[51] Int. Cl.[5] ..... G10D 13/02

[52] U.S. Cl. ..... 84/411 R; 84/413

[58] Field of Search ..... 84/411–421

[56] References Cited

U.S. PATENT DOCUMENTS

| | | | |
|---|---|---|---|
| 1,381,494 | 6/1921 | Olsen | 84/411 R |
| 1,429,843 | 9/1922 | Christian | 84/411 R |
| 1,615,202 | 1/1927 | Hagen | 84/411 R |
| 3,421,400 | 1/1969 | Yokoi | 84/411 R |
| 3,647,931 | 3/1972 | Koishikawa | 84/411 R |
| 4,045,264 | 8/1977 | Ludwig et al. | 84/411 R |
| 4,295,405 | 10/1981 | Sleishman | 84/411 R |
| 4,344,349 | 8/1982 | Cordes | 84/411 R |

*Primary Examiner*—Lawrence R. Franklin

[57] ABSTRACT

A multi-annular musical drum instrument formed from a plurality of axially aligned permanently connected rings. Each ring formed of a multi-annular ring of laminated plywood, a solid wood or other desireable material. Each ring is non-jointed and undivided in the circumferential direction so as to be formed of a single piece rather than a composite of sections so as to provide uniform vibratory characteristics. One or more of the rings functons as a sounding ring having a greater outer radius than the other shell rings. Such sounding rings receive a connection to a respective drum head. Two rings form outer rings of the cylindrical shell contacting the respective drum heads. Either or both of the two may be rounded to decrease the overtones of the drum head, pointed to increase the overtones of the drum head, or flat so as not to alter the overtones of the drum head. The simplified construction provides a drum having a natural sound without rattling noises or a tin sound elsewhere caused by moving parts and extraneous brackets.

20 Claims, 2 Drawing Sheets

MULTI-ANNULAR MUSICAL DRUM

FIELD OF THE INVENTION

This invention relates to a musical drum instrument, and more particularly to the novel multi-annular construction of a musical drum instrument. A plurality of non-jointed multi-annular rings are stacked to form a generally cylindrical drum shell. Drum heads are fastened to the shell at sounding rings which are rings of greater outer radius than the other rings. The rings contacting the drum head are shaped so as to enable a wide range for tuning the drum. Accordingly, the end rings are flat rounded or generally pointed.

BACKGROUND

Musical drums are percussion instruments generally including two drum heads mounted on a cylindrical drum shell. Typically, the drum heads are held in place against the drum shell by hoops or rims. Some drum varieties include only one drum head, such as the bongo drum and some base drums. The snare drum, in addition to having two drum heads, also includes wires stretched across one of the drum heads which beat against the drum head when the head vibrates. The wires generate high frequency sound waves altering the sound of the drum.

As shown in FIG. 1, conventional wooden drum shells 10 are constructed from multiple layers 12, 14, 16, . . . overlaid upon each other in the radial direction r.

U.S. Pat. No. 1,381,494 discloses a drum formed from annular courses united side by side to form a composite unitary structure in which each course is composed from a plurality of sections connected end to end to form a ring. In accordance with such construction each course is jointed along the circumference, connected by glue, cement or the like. Thus, the material is not uniform along the circumference. The varying material results in the annular course having varying vibration characteristics along the circumference. Further, as the courses and sections are connected with glue, cement or the like, the relative position of the courses may vary during construction.

According to the present invention, non-jointed annular rings ar used to maintain the uniformity of material along the circumference of the drum shell. The non-jointed rings, preferably, are formed from a laminated plywood. Pins are inserted into adjacent rings to precisely position the rings relative to one another. Accordingly, a controlled smooth inner drum shell surface is achievable with the inner radii of the rings being aligned to the desired positions.

As the musician strikes the drum, the sound waves travel through the air within the drum shell resulting in the vibration of the drum heads and the drum shell. In the past, metal brackets or the like have been attached to the drum shell for holding the drum heads in place. The added structure, however, changes the vibration characteristics of the drum shell altering the structure's natural resonance frequency. A pure or more natural sound is achieved according to this invention by eliminating the brackets and including sounding rings of greater outer radius than the other rings and fastening the drum heads to respective sounding rings. The sounding rings are made from the same material as the other rings resulting in a uniformly composed drum shell.

The sounding rings include threaded metal inserts into which a bolt connecting the drum head to the sounding ring is attached. This avoids the prior art use of lug nuts and spring loaded lug nuts about the drum shell. Such lug nuts and springs lead to undesired vibrations and rattling which now can be avoided. This is particularly important for studio work in which the springs often have to be removed to avoid unacceptable rattling noises. According to this invention the rattling problem is avoided.

Musical drums are tuned by adjusting the tension of the skin comprising the drum head. This is achieved by selectively adjusting the bracket fasteners or the like which connect the drum head to the drum shell. According to this invention a wide tuning range is achieved by providing an end ring in contact the drum head which has a flat contact surface, substantially rounded contact surface or a generally pointed contact surface. The varying shape provides differing damping characteristics so as to vary the number of overtones produced in the drum head. As a result, the bolts or the like connected to the sounding ring and pressing the drum head to an end ring are adjusted to give a wide tuning range.

The musical drum according to this invention also provides a new natural look to the drum instrument. The stacked non-jointed layers including the sounding rings may be stained with any one or more of various natural wood stains.

SUMMARY OF THE INVENTION

It is an object of the invention to provide a multi-annular musical drum instrument having a simplified construction for ease in tuning and operation.

It is another object of the invention to provide a multi-annular musical drum instrument in which each annulus is non-jointed along the circumference forming one continuous ring providing uniform vibration of the drum shell throughout each annulus. Uniformity of the material along the circumference provides uniform vibration characteristics of each annular ring along the circumference.

It is another object of this invention to provide a musical drum instrument formed from axially aligned non-jointed annular rings. Such non-jointing provides for a more rigid more durable drum having a great resistance to warping.

It is another object of this invention to provide a musical drum instrument formed from axially aligned non-jointed annular rings in which the rings are aligned with pins which precisely position the rings relative to one another.

It is another object of the invention to provide a multi-annular musical drum instrument having a sounding ring to which a drum head is secured. Accordingly, metal brackets or the like need not be attached to the drum shell enabling the shell to vibrate at its natural frequency. Excess parts and varying materials are avoided enabling a pure natural drum sound.

It is another object of the invention to provide a multi-annular musical drum instrument having a sounding ring for avoiding undesirable rattling noises. The sounding ring includes threaded metal inserts to which the drum head is fastened. Springs and lug nuts are avoided so as to avoid the corresponding rattling attributed to such parts.

It is another object of the invention to provide a musical drum instrument having an end ring which is rounded at the edge contacting the drum head so as to reduce the drum head overtones.

It is another object of the invention to provide a musical drum instrument having an end ring which is generally pointed at the edge contacting the drum head so as to increase the drum head overtones.

It is another object of the invention to provide a musical drum instrument having a wooden drum shell able to maintain its generally cylindrical shape without significant warping.

These and other objects of the invention are provided by a multi-annular musical drum instrument including a plurality of annular drum shell rings. Each drum shell ring is non-jointed along its circumference to provide a continuous ring providing uniform vibration. The plurality of rings are axially aligned and permanently connected to form a generally cylindrical drum shell. Pins are positioned axially into adjacent rings to precisely position the rings relative to one another and reliably enable such position to be maintained.

One or more of such rings function as sounding rings which have a greater outer radius than the other shell rings. The sounding rings include threaded metal inserts which receive bolts or the like connecting the drum head to the sounding ring. As a result the drum heads are adjustably attached to respective sounding rings. Tuning of the drum is achieved by working with the bolts to tighten or loosen the drum head. An end ring of the drum shell which contacts the drum head may be substantially rounded to decrease the drum head overtones, generally pointed to increase the drum head overtones, or flat so as not to alter the drum head overtones. For drums having two heads, and thus two sounding rings, the two end rings can have differing shapes so as to provide different damping characteristics between the two heads and allow a wider tuning range of the drum.

DETAILED DESCRIPTION OF A PREFERRED EMBODIMENT OF THIS INVENTION

Figure 1:
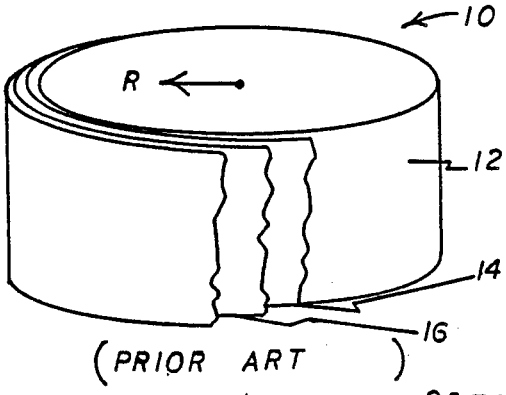
(PRIOR ART) FIG. 1
FIG. 1 is a partial cutaway view of a prior art drum shell.
Figure 3:
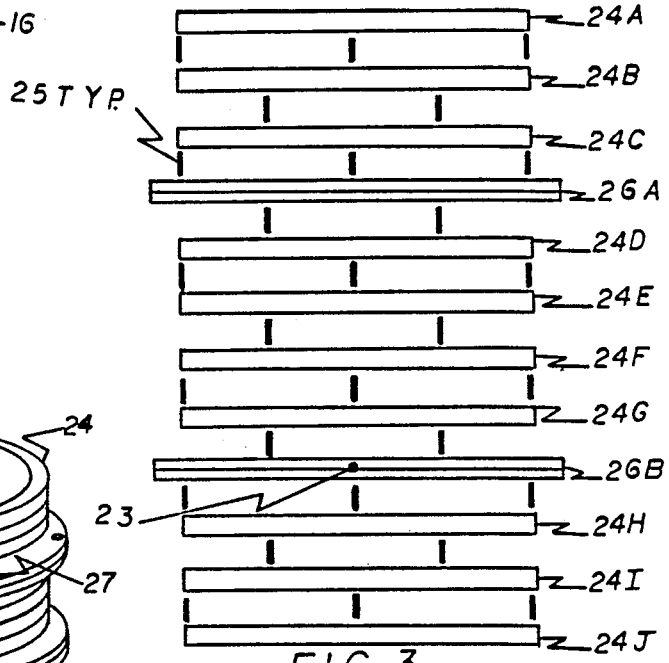
FIG. 3 is an exploded view of the FIG. 2 embodiment.
Figure 4:
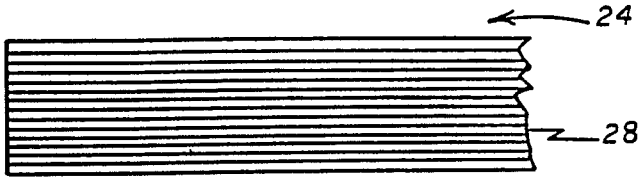
FIG. 4 is a sectional view of one ring of the FIG. 2 embodiment.

Referring to FIGS. 2–9 a multi-annular music drum is shown according to a preferred embodiment of this invention. The drum 20 includes a drum shell 22 formed from a plurality of annular drum shell rings 24, 26. Each ring 24, 26 is one continuous non-jointed ring along its circumference so as to vibrate uniformly. Each ring may be formed from a solid or multi-annular ring of wood, plastic, fiberglass or other material, preferably wood. Referring to FIG. 4, a section of a laminated wood ring 24 formed from annular layers 28 is shown. Preferably, the wooden multi-annular ring 24 is generated by cutting a ring from a board of laminated plywood of desireable stock, such as baltic birch or apple core.

The shell rings 24, 26 are axially aligned and permanently connected to form a generally cylindrical drum shell. Although a substantially cylindrical shell is shown, the generally cylindrical drum shell may be curved such that the shell has a smaller diameter at the ends, may be angled such that the diameter at one end is greater than at the other end, or otherwise altered to form such a generally cylindrical shape.

Figure 2:
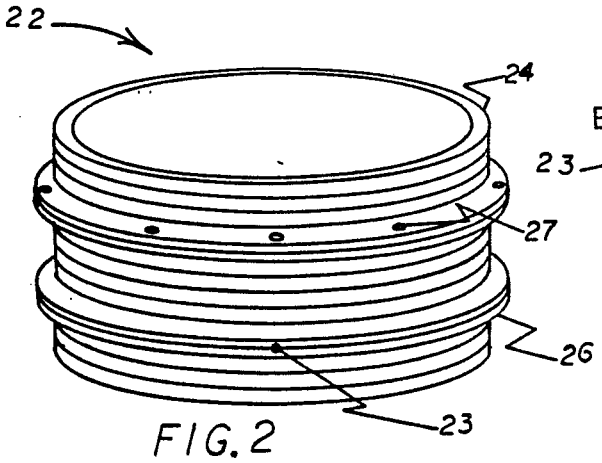
FIG. 2 is a perspective view of an embodiment of a multi-annular drum shell for a musical drum according to this invention.

Referring to FIGS. 2 and 3, the drum shell 22 includes two aligned air holes 23 along a sounding ring 26 for letting air out of the drum upon being struck.

Figure 5:
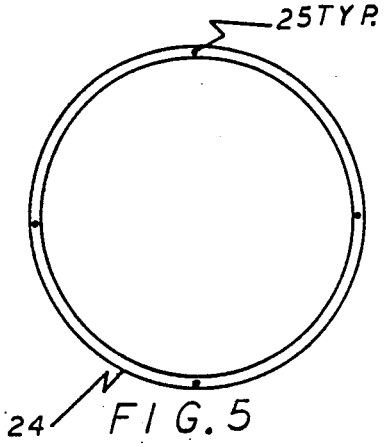
FIG. 5 is an axial view of one standard ring of the FIG. 2 embodiment.

Referring to FIGS. 3 and 5, pins 25, preferably made from a metal alloy or another rigid material, are embedded into adjacent rings to radially align and maintain the relative ring positions. As can be seen in the view shown in FIG. 5, four pins 25 are used between adjacent rings. By using the pins to radially align the rings, a uniform smooth outer and inner surface is achieved resulting in uniform vibrations within the drum shell. In addition, the pins 25 add to the shell's rigidity maintaining its shape over time.

The drum shell of FIG. 2 has two sounding rings 26 for a drum having two drum heads. Each drum head is attached to a respective sounding ring 26. Comparing FIGS. 5 and 6, the sounding rings 26 have a larger outer diameter than the other shell rings 24. Such larger diameter provides an external ring to which the drum heads may be adjustably connected. By adjusting the connection so as to alter the tension of the skin of the drum head, the instrument is tuned.

Figure 9:
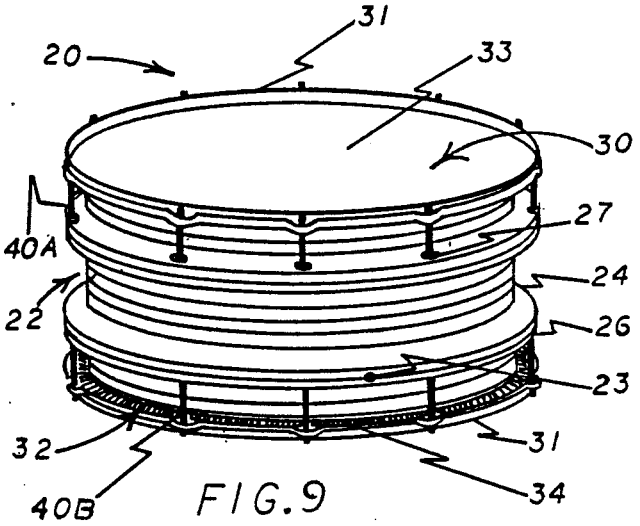
FIG. 9 is a perspective view of an embodiment of a multi-annular drum according to this invention.
Figure 6:
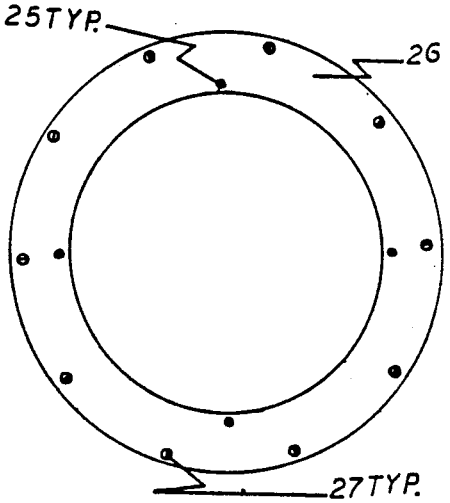
FIG. 6 is an axial view of one sounding ring of the FIG. 2 embodiment.

Referring to FIG. 6, the sounding ring includes threaded metal inserts 27 fitted to precise tolerances. These inserts 27, as shown in FIG. 9, respectively receive a bolt 40 or the like for fastening the drum head 30 to the drum shell 22. In the preferred embodiment lug nuts and springs are avoided to prevent undesirable rattling noises.

Figure 7:
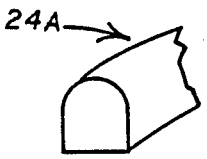
FIG. 7 is a sectional view of a rounded end ring of the FIG. 2 embodiment.
Figure 8:
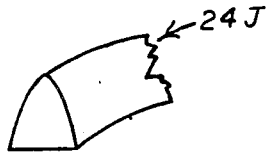
FIG. 8 is a sectional view of a generally pointed end ring of the FIG. 2 embodiment.

Other improvements for altering the drum head sound include a shaping of the end ring in contact with the drum head so as to alter the drum head overtones. Referring to FIGS. 2 and 7, an outer ring **24*a* may be rounded at the edge which contacts the drum head so as to decrease the number of overtones. Referring to FIGS. 2 and 8, an outer ring 24*j* alternatively may be generally pointed at the edge so as to increase the number of overtones. As shown the edge of ring 24*j* is rounded at the point so as not to cut the skin of the drum head during use. Note that the edge in FIGS. 7 and 8** contacting the drum skin is not at the outer radius of the ring, but centered between the inner and outer radius providing more surface area in contact with the skin. Previously the edge has been positioned at the outer diameter. Still another alternative is to leave the edge flat so as not to alter the drum head overtones. By including differing edge shapes for the two end rings, the drum achieves a wide tuning range.

Referring to FIG. 9, an assembled multi-annular drum is shown including the drum heads 30, 32. The heads 30, 32 include a drum skin 33 secured to a metal ring 34. A metal hoop 31 holds the head to the shell. Bolts 40 or other fastening devices may be used to secure the drum heads by fastening the metal hoop 31 to a sounding ring 26. Each sounding ring 26 as shown in FIG. 6 includes a plurality of inserts 27 for receiving the bolts 40. The drum head tension may be adjusted, and thus the instrument tuned, by adjusting the bolts 40.

Although preferred embodiments have been described and illustrated the invention is not intended to be limited to the exact embodiments. The scope of the invention is intended to be determined by the claims interpreted in light of the prior art.

I claim:

1. A multi-annular music drum comprising:

a plurality of annular shell rings, each ring being non-jointed along its circumference, said plurality of shell rings axially aligned and permanently connected to form a generally cylindrical drum shell.

2. The drum of claim 1 further comprising a plurality of pins for aligning adjacent rings, said pins extending axially into said adjacent rings.

3. The drum of claim 1 in which said plurality of rings comprise the same material and include a sounding ring to which a drum head may be attached, said rings forming a drum shell having a resonance frequency approximating the natural resonance frequency of said material.

4. The drum of claim 1 in which said plurality of rings comprise a sounding ring, and further comprising a plurality of threaded metal inserts embedded in said sounding ring so as not to rattle during use of the drum.

5. The drum of claim 1 in which each shell ring is comprised of a plurality of annular layers.

6. The drum of claim 1 in which each ring has substantially the same inner radius.

7. The music drum of claim 1 in which one of said shell rings forms an edge of said drum shell for contacting a drum head, said edge being substantially rounded to decrease the number of overtones of the drum head.

8. The music drum of claim 1 in which one of said shell rings forms an edge of said drum shell for contacting a drum head at a position between an inner and outer radius of said one of said shell rings, said edge being generally pointed to increase the number of overtones of the drum head.

9. A multi-annular music drum comprising:

a plurality of annular shell rings, each ring being non-jointed along its circumference, said plurality of shell rings axially aligned and permanently connected to form a generally cylindrical drum shell;

a sounding ring of said plurality of shell rings having a greater outer radius than the other shell rings, said sounding ring comprising means for receiving a drum head fastener.

10. The drum of claim 9 further comprising a plurality of pins for aligning adjacent rings, said pins extending axially into said adjacent rings.

11. The drum of claim 9 in which said plurality of rings comprise the same material and form a drum shell having a resonance frequency approximating the natural resonance frequency of said material.

12. The drum of claim 9 further comprising a plurality of threaded metal inserts embedded in said sounding ring so as not to rattle during use of the drum.

13. The drum of claim 9 in which one of said shell rings forms an edge of said drum shell for contacting a drum head, said edge being substantially rounded to decrease the number of overtones of the drum head.

14. The music drum of claim 9 in which one of said shell rings forms an edge of said drum shell for contacting a drum head at a position between an inner and outer radius of said one of said shell rings, said edge being generally pointed to increase the number of overtones of the drum head.

15. A multi-annular music drum comprising:

a first and a second drum head;

a drum shell comprising a plurality of annular shell rings, each ring being non-jointed along its circumference, said plurality of shell rings axially aligned and permanently connected to form a generally cylindrical drum shell, said plurality of shell rings comprising one or more sounding rings having a greater outer radius than the other shell rings;

means for adjustably fastening a drum head to a sounding ring; and means for tuning said drum in which a first and second end ring of said plurality of rings respectively in contact with said first and second drum head are shaped at the edges in contact with said drum heads to provide different overtone characteristics for the respective drum heads.

16. The drum of claim 15 further comprising a plurality of pins for aligning adjacent rings, said pins extending axially into said adjacent rings.

17. The drum of claim 15 in which said plurality of rings comprise the same material so that said drum has a resonance frequency approximating the natural resonance frequency of said material.

18. The drum of claim 15 further comprising a plurality of threaded metal inserts embedded in said sounding ring so as not to rattle during use of the drum.

19. The music drum of claim 15 in which said edge of said first end ring is substantially rounded to decrease the number of overtones of the drum head.

20. The music drum of claim 15 in which one of said shell rings forms an edge of said drum shell for contacting a drum head at a position between an inner and outer radius of said one of said shell rings, said edge being generally pointed to increase the number of overtones of the drum head.

* * * * *